United States Patent [19]

Rother

[11] 4,139,923

[45] Feb. 20, 1979

[54] SUCTION ATTACHMENT FOR VACUUM CLEANER

[75] Inventor: Eberhard Rother, Wuppertal, Fed. Rep. of Germany

[73] Assignee: Vorwerk & Co. Interholding GmbH, Wuppertal, Fed. Rep. of Germany

[21] Appl. No.: 780,251

[22] Filed: Mar. 22, 1977

[30] Foreign Application Priority Data

Mar. 23, 1976 [DE] Fed. Rep. of Germany ..... 2612160

[51] Int. Cl.[2] ..... A47L 9/06

[52] U.S. Cl. ..... 15/339; 15/365; 15/367; 15/373

[58] Field of Search ..... 15/339, 365, 367, 368, 15/373

[56] References Cited

U.S. PATENT DOCUMENTS

| | | | |
|---|---|---|---|
| 3,727,263 | 4/1973 | Johansson | 15/373 |
| 3,952,363 | 4/1976 | Lindman | 15/373 |

FOREIGN PATENT DOCUMENTS

| | | | |
|---|---|---|---|
| 2136452 | 2/1973 | Fed. Rep. of Germany | 15/373 |
| 2220815 | 11/1973 | Fed. Rep. of Germany | 15/373 |
| 1433534 | 4/1976 | United Kingdom | 15/373 |

*Primary Examiner*—Christopher K. Moore
*Attorney, Agent, or Firm*—Michael J. Striker

[57] ABSTRACT

A suction attachment for a vacuum cleaner has a housing component and a brush component which is accommodated within the housing component. Two mounting members mount the brush component in the housing component for displacement between a retracted position in which the brushes of the brush component are received within the housing component, and an extended position in which the brushes extend to the exterior of the housing component and into contact with a surface to be vacuum cleaned. The mounting components are interconnected by connecting members for synchronous pivoting about spaced pivot axes. Each mounting member is pivotally mounted on the brush component and has a support portion which engages the housing component. One of the mounting members has an actuating portion which is acted upon by an actuating element for pivoting the mounting members into positions corresponding to the extended position of the brush component against a biasing force, and a releasing portion acted upon by a flexible portion of the actuating element for releasing the mounting members and the brush component for displacement of the latter toward the retracted position. The other mounting member may have faces of distinctive appearance which are visible through a window of the housing component and indicate the position of the brush component.

18 Claims, 4 Drawing Figures

FIG. 3
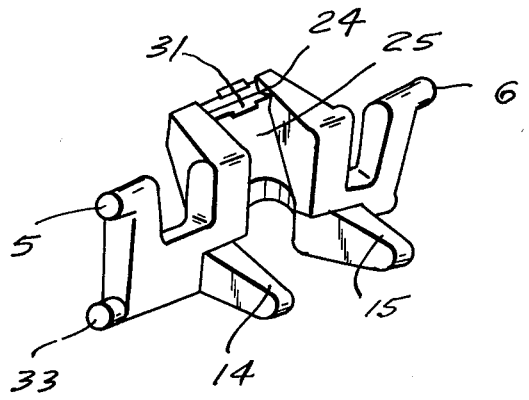
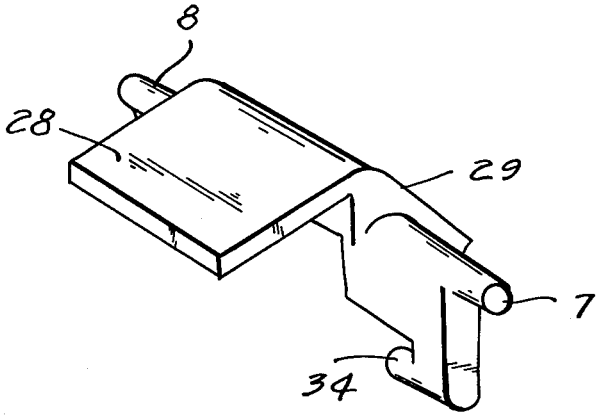
FIG. 4

SUCTION ATTACHMENT FOR VACUUM CLEANER

BACKGROUND OF THE INVENTION

The present invention relates to a suction attachment for a vacuum cleaner in general, and more particularly to a suction attachment having a housing component which may be used by itself or in combination with a brush component accommodated in the interior thereof.

There are already known various attachments of the type mentioned above, in most of which the brush component is accommodated in the interior of the housing component and is biased toward a retracted position thereof in which the bristles of the brush component are received within the housing component, while the brush component is capable of assuming an extended position relative to the housing component in which the bristles of the brush component extend beyond the housing component and into contact with a surface to be cleaned during the use of the attachment. The displacement of the brush component between the positions thereof is, in most instances, achieved by means of an actuating element which extends from the interior of the housing component to the exterior thereof to be accessible to the user of the attachment, and which is to be depressed both when the brush component is to be displaced towards its extended position, and to its retracted position, the actuating element always returning to its initial position after displacing the brush component relative to the housing component. The attachment has a central exhaust port or conduit communicating with the interior of the housing component and also with the vacuum cleaner during the use of the attachment, so that the vacuum cleaner exhausts air and any contaminants entrained therein from the interior of the housing component through the exhaust port.

In one attachment of this type, a single actuating element is provided which is capable of displacing the brush component relative to the housing component either from the retracted toward the extended position, or from the extended toward the retracted position. In this proposed attachment, there is employed a so-called slotted link switch having a cam plate provided with a guide slot and the actuating element has a projection which is guided in the guide slot of the cam plate. The guide slot of the cam plate is so configurated that it arrests the actuating element in a lower position thereof in which the actuating element holds the brush component in the extended position thereof. In other words, the actuating element does not return to its initial position upon displacing the brush component into the extended position. Now, when the actuating element is depressed again, the projection of the actuating element is guided in the guide slot and along an inclined surface, pushes the slotted link switch aside about a turning axis of the latter and thus lets the brush component return into its retracted position.

This proposed attachment is disadvantageous in that an additional structural element, that is the so-called slotted link switch, is needed for arresting the brush component in the individual positions thereof, as well as for the mechanical cooperation of the various components. It is furthermore of a significant disadvantage, that due to the mechanical construction as well as to the mechanical cooperation of the various elements, the so-called slotted link switch must conduct a tilting movement about its turning axis. This results in an economically unsupportable expenditure both in terms of cost and complexity of construction; furthermore, the various elements of this proposed attachment must be manufactured and assembled with extreme care inasmuch as otherwise any misalignment or tolerance imprecisions will result in rapid destruction either of the axle of the switch or of the bearing in which such axle is received.

In addition thereto, such a construction requires for its operation the provision of a plurality of springs the properties of which must be constantly supervised during the manufacture thereof.

Moreover, there has also been already proposed a different attachment for use in connection with vacuum cleaners which is also capable of being operated by means of only one actuating element for displacing the brush component relative to the housing component between the extended and retracted position of the brush component. In this particular attachment, a ratchet mechanism is provided in the actuating element, which brings the brush component in its extended position by means of a turnable bracket. The ratchet mechanism includes, at the two ends thereof, projections which enclose an angle of 180° with one another, which are turned during each actuation of the actuating element by 90° and thus, on the one hand, press the brush component via the bracket downwardly and, on the other hand, release the brush component for displacement toward the retracted position thereof. The ratchet mechanism serves to prevent unintended retraction of the projections during the exertion of a downwardly directed force on the attachment.

Experience with this particular type of attachment has shown that the actuation of the brush component by means of the bracket which is of a generally U-shaped configuration, is particularly disadvantageous. Inasmuch as the bracket acts on the brush component substantially in the central region thereof, it is always possible to turn one side of the brush component about the point where the brush component is mounted on the bracket, and into the interior of the housing component, so that the brush component is incapable of assuming a stable position relative to a smooth surface to be vacuum cleaned.

It is further disadvantageous in this construction of the attachment that the distribution of the various forces acting on the components of the attachment is so disadvantageous that the projections are subjected to excessive forces.

SUMMARY OF THE INVENTION

Accordingly, it is the general object of the present invention to avoid the disadvantages of the prior art.

More particularly, it is an object of the present invention to provide an attachment for use in connection with vacuum cleaners which is not possessed of the disadvantages of the prior-art attachments.

It is a further object of the present invention to provide an attachment for a vacuum cleaner in which the brush component is reliably held in the extended position thereof.

Yet another object of the present invention is to design an attachment for vacuum cleaners which is simple in construction, reliable in operation, and inexpensive to manufacture.

A concomitant object of the invention is to so construct the arrangement for mounting the brush component in the housing component that the action of the various forces to which the attachment is subjected on the mounting arrangement is minimized.

In pursuance of these objects and others which will become apparent hereafter, one feature of the present invention resides, briefly stated, in a suction attachment for vacuum cleaners, which comprises a housing component having a portion juxtaposable with a surface to be vacuum cleaned, an interior which opens onto said portion and an exhaust port communicating with said interior and connectable to a vacuum cleaner; a cleaning component accommodated in said interior of said housing component and having a cleaning portion; means for mounting said cleaning component on said housing component for displacement relative thereto between a retracted position in which said cleaning portion is received in said interior and an extended position in which said cleaning portion extends to the exterior of said housing component and beyond said portion of the latter into cleaning contact with the surface, including at least two mounting members mounted on one of said components for pivoting about respective pivot axes relative thereto and each having a support portion engaging the other component and a connecting portion, said portions being spaced from the respective pivot axis; means for urging said cleaning component toward said retracted position thereof; and means for simultaneously pivoting said mounting members about said respective pivot axes, including means for angularly displacing one of said mounting members about the respective pivot axis thereof, and at least one connecting member articulated to said connecting portions of said mounting members and operative for angular displacing the other mounting member in synchronism with said one mounting member.

In a currently preferred embodiment of the above concept, both of said components are elongated and have longitudinally spaced ends, the pivot axes of the mounting members being respectively situated at said ends of said components, and the connecting member extending longitudinally of said components. Preferably, the connecting portions are arranged at one of the transversely spaced end portions of each of the mounting members, and each of said mounting members has an additional connecting portion at the other end portion thereof, an additional connecting member being articulated to the additional connecting portions of the mounting members and extending parallel to the above-mentioned one connecting member. The housing component has a central portion intermediate the spaced ends of the components, and the exhaust port is provided at the central portion.

In an advantageous embodiment of the present invention, the angularly displacing means includes an actuating element mounted on the housing component for displacement relative thereto in a path between a first and a second position and having a contact portion accessible from the exterior of the housing component, and means for biasing the actuating element toward the above-mentioned first position thereof. In this embodiment, the one mounting member has at least one actuating portion which is spaced from the respective pivot axis of the one mounting member and extends into the path of displacement of the actuating element in order to be displaced by the latter during the displacement of the same towards said second position thereof and thereby angularly displace the one mounting member toward a position corresponding to the extended position of the cleaning component. The actuating element advantageously has an inclined surface contacting the actuating portion during the displacement of the actuating element between the first and second positions and during the displacement of the cleaning body between the retracted and extended positions.

According to a further preferred concept of the present invention, the other component has at least one slanted surface in engagement with said support portion of said other mounting member, and the mounting and connecting members are so situated with respect to the other component in said extended position of said cleaning component that said support portion of said other mounting member arrests said other mounting member on said slanted surface against angular displacement towards said retracted position of said cleaning component.

The attachment of the present invention advantageously further comprises means for arresting the cleaning component in the extended position thereof, and the actuating element further includes means for releasing the cleaning component for displacement toward the retracted position thereof including a flexible element connected to the actuating element for joint displacement therewith and for flexing relative thereto, and a releasing portion of the one mounting member spaced from the respective pivot axis of the latter and extending into the path of displacement of the flexible element when the cleaning component is in the extended position thereof. The releasing portion of the one mounting member preferably has a side surface which engages and flexes the flexible element during the displacement of the cleaning component toward the extended position thereof.

It is advantageous for the proper operation of the mounting and angularly displacing means that the actuating and releasing portions of the one mounting member be disposed about the respective axis of the latter at an angle of substantially 90°. It is of further advantage when the releasing portion of the one mounting member has an end face formed with a depression adapted to receive an end portion of the flexible element.

According to a further advantageous aspect of the present invention, the other mounting member has two faces which enclose with one another an angle substantially corresponding to the range of angular displacement of the other mounting member about the respective pivot axis thereof. Then, the housing component has a display window in registry with the respective face of the other mounting member in each of the positions of the cleaning component. Each of said faces may have an appearance distinct from that of the other face so that the instantaneous position of the cleaning component is indicated by the appearance of the respective distinctive face of the other mounting member in the display window for the housing component.

The above-discussed concepts of the present invention are preferably embodied in an attachment in which the cleaning component has a cleaning portion consisting of a plurality of bristles which dislodge dirt and other contaminants from the surface being cleaned during the operation of the attachment in conjunction with a vacuum cleaner.

When the attachment for a vacuum cleaner is constructed in the manner discussed above, it is achieved, in a particularly advantageous manner, that the brush component obtains a wide foundation for supporting the same in the extended position thereof as a result of the arrest of the mounting and connecting members in the positions thereof corresponding to the extended position of the brush component, so that the latter can no longer be tilted.

It is further advantageous that, as a result of the support of the mounting members in the one component and their forced pivoting movement at the end points thereof, no misalignment of the brush component relative to the housing component can occur. In addition thereto, it is of a particular advantage that the various forces acting on the housing component, such as that attributable to the weight of the vacuum cleaner, do not determine or influence the actuation of the brush component and the displacement thereof between the positions thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a perspective view of one of the mounting members used in the attachment of FIG. 1; and FIG. 4 is a perspective view of another mounting member used in the attachment of FIG. 1.

DETAILED DISCUSSION OF THE PREFERRED EMBODIMENT

Figure 1:
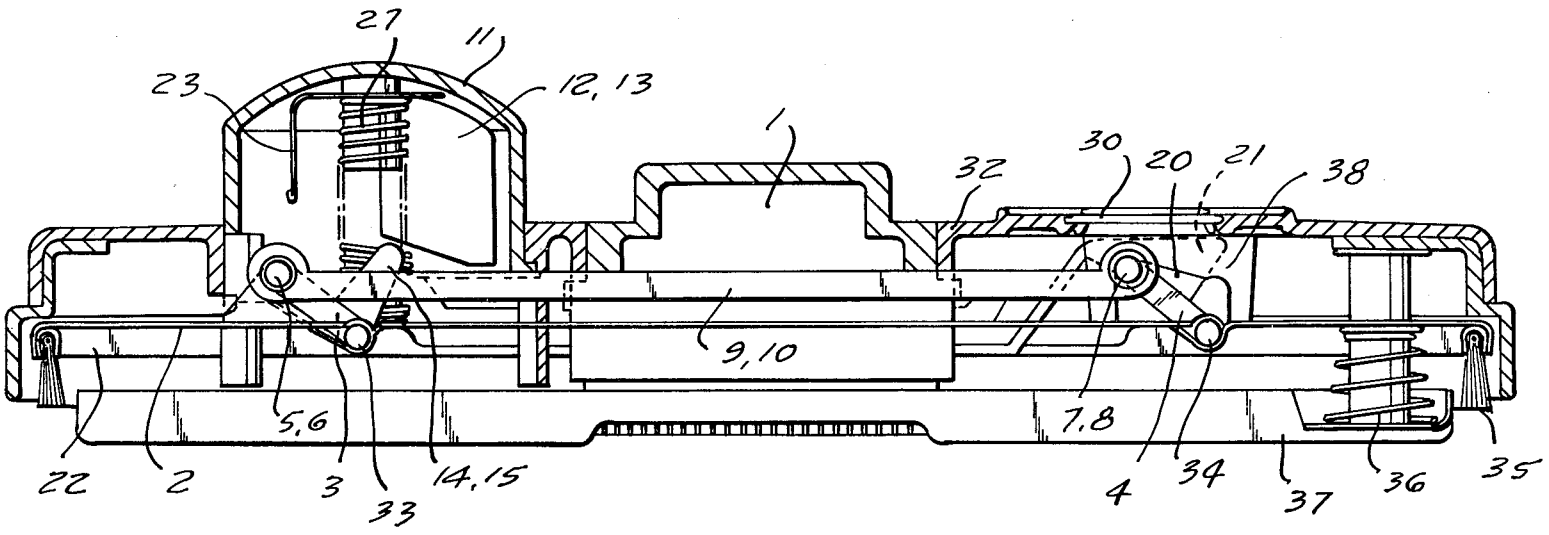
FIG. 1 is a sectional view of an attachment of the present invention with the brush component in the retracted position thereof.
Figure 2:
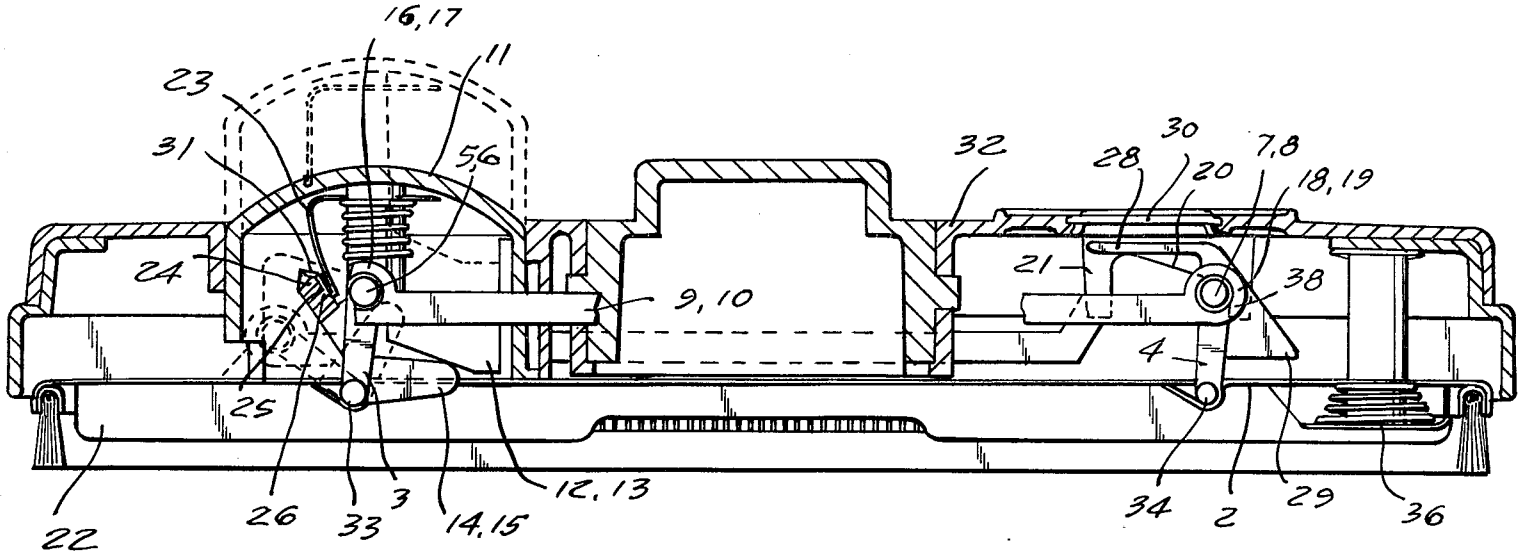
FIG. 2 is a view similar to FIG. 1 but with the brush component in its extended position.

Referring now to the drawing in detail, and first to FIGS. 1 and 2, it may be seen therein that the example of the embodiment of the attachment of the present invention illustrated therein includes a housing component 32 and a brush component 22 which is accommodated in the interior of the housing component 32. Two mounting members 3 and 4 mount the brush component 22 in the housing component 32 for displacement between a retracted position illustrated in FIG. 1, and an extended position illustrated in FIG. 2. An exhaust element 1 is provided at the central portion of the housing component 32 and has an exhaust port through which air with entrained contaminants is withdrawn from the interior of the housing component toward a non-illustrated conventional vacuum cleaner.

The brush element 22 includes a base plate 2 on which there is mounted a brush portion or strip 35. The mounting members 3 and 4 have stub shafts 33 and 34 which are pivotably mounted on the base plate 2 of the brush component 22.

Referring now to FIGS. 3 and 4, which illustrate in detail the configuration of the mounting members 3 and 4, it may be seen therein that the mounting member 3 illustrated in FIG. 3 has connecting portions 5 and 6 which are spaced from the stub shafts 33, actuating portions 14 and 15, and a releasing portion 24 having a depression 31 and a surface 25. On the other hand, the mounting member 4 illustrated in FIG. 4 has additional connecting portions 7 and 8 spaced from the stub shafts 34, and display portions 28 and 29 having respective display faces.

Coming back to FIGS. 1 and 2, it may be seen therein that a connecting member or bar 9 is articulated to the connecting portions 5 and 7 of the mounting members 3 and 4 and thus interconnect the same. Similarly, the connecting portions 6 and 8 of the mounting members 3 and 4 are interconnected by a connecting member or bar 10 which is concealed by the connecting element 9 in the illustration of FIGS. 1 and 2.

The brush component 22 is supported in the interior of the housing component 32 by means of a plurality of springs 36 of which only one has been illustrated in order not to unduly encumber the drawing. The housing component 32 includes a bottom plate 37, and the springs 36 extend between and act on the bottom plate 37 of the housing component 32, and the base plate 2 of the brush component 22.

FIGS. 1 and 2 further show an operator engaged actuating element 11 which is hollow and has in its interior two actuating ribs 12 and 13 and a flexible portion 23. Here again, the actuating rib 13 is hidden behind the actuating rib 12. A spring 27 extends between the base plate 2 and the actuating element 11 and urges the same permanently toward the position thereof illustrated in FIG. 1.

The connecting elements 9 and 10 are elongated and have respective end portions 16 and 18 or 17 and 19, respectively, articulated to the stub shafts 5 and 7, or 6 and 8 of the mounting members 3 and 4, respectively.

The actuating ribs 12 and 13 of the actuating element 11 have inclined surfaces which come into contact with the actuating portions 14 and 15, of the mounting member 3 during the downward displacement of the actuating element 11 which is accompanied by the displacement of the brush component 22 from the retracted toward the extended position of the same. The flexible portion 23 of the actuating element 11 has a contact surface 26 adapted to abut against the contact surface 25 of the releasing portion 24 of the mounting member 3 in a manner illustrated in FIG. 2.

A support casing 21 is supported in the interior of the housing component 32 and has a slanted surface 20 formed with a notch 38 at one of its ends, as particularly seen in FIG. 1. The housing component 32 further includes a display window 30 in the vicinity of the mounting member 4.

Having so described the structure of the attachment of the present invention, the operation thereof will now be briefly discussed.

Beginning with the positions of the various parts of the attachment of the present invention which are illustrated in FIG. 1, that is, beginning with the situation where the brush component 22 is in its retracted position relative to the housing component 32, from which retracted position the brush component 22 is to be displaced into its extended position illustrated in FIG. 2, it will be appreciated that the downward displacement of the actuating element 11 will result in abutment of the actuating ribs 12 and 13 of the actuating element 11 against the actuating portions 14 and 15 of the mounting member 3 so that the mounting member 3 will be pivoted about its pivot axis defined by the stub shaft 33 in the clockwise direction as illustrated in the drawing. Simultaneously, the connecting members 9 and 10 will also pivot the mounting member 4 in clockwise direction about the pivot axis thereof defined by the stub shafts 34 toward the position illustrated in FIG. 2. When in the latter position, the brush component 22 is in its extended position and the connecting portions 7 and 8 of the mounting member 4 are substantially in alignment with the ends 16, 17, 18 and 19 of the connecting members 9 and 10. During the displacement from the positions illustrated in FIG. 1 to those illustrated in FIG. 2, the connecting portions 7 and 8 of the mounting member 4 slide along the slanted surface 20, respectively, until they reach and are received in the respective notches 38. The sliding movement of the connecting portions 7 and 8 along the inclined or slanted surfaces 20 results in a downward relative movement of the brush component 22 with respect to the housing component 32 and in compression of the springs 36. While not illustrated for the sake of keeping the drawing simple, similar support casings 21 with their slanted surfaces 20 and notches 38 may also be provided for and cooperate with the connecting portions 5 and 6 of the mounting member 3, in which event the mounting members 3 and 4 and the connecting members 9 and 10 will be uniformly supported on the support casings 21 in the regions of all four connecting portions 5, 6, 7 and 8.

The springs 36 press the connecting portions 5, 6, 7, 8 and thus the ends 16, 17, 18 and 19 of the connecting members 9 and 10 into the respective notches 38 and thus hold the same arrestingly in such notches 38.

During the above-described clockwise pivoting of the mounting member 3, the releasing portion 24 also pivots and the contact surface 25 of the same abuts against the contact surface 26 of the flexible portion 23 of the actuating element 11, so that the flexible portion 26 is deflected. Now, when the actuating element 11 is released, with the brush component 22 in its fully extended position, the spring 37 returns the actuating element 11 into its initial position illustrated in FIG. 2 in broken lines. During such return displacement, the flexible portion 23 of the actuating element 11 is released from its contact with the contact surface 25 of the release portion 24 of the mounting member 3 and thus returns into its initial position in which it is in registry with the depression 31 of the release portion 24 of the mounting member 3 in the position of the latter illustrated in FIG. 2.

Thereafter, when it is desired to return the brush component 22 into its retracted position, the actuating element 11 is depressed again, as a result of which the flexible portion 23 enters into the depression 31 of the release portion 24 of the mounting member 3, is retained therein against transverse movement and thus against disengagement from the releasing portion 24, and presses the latter downwardly and thus the mounting 3 in the counterclockwise direction. Here again, the mounting member 4 conducts the same angular displacement as the mounting member 3 due to its interconnection with the same via the connecting members 9 and 10. The connecting portions 5, 6, 7, and 8 of the mounting members 3 and 4 and the ends 16, 17, 18, and 19 of the connecting members 9 and 10 are freed from their confinement in the notches 38 and thus follow the slope of the slanted surfaces 20. The springs 36 exert forces on the brush component 22, which results in return sliding of the connecting portions 5, 6, 7, and 8 along the inclined surfaces 20 into their original positions illustrated in FIG. 1, so that the brush component 22 returns into its retracted position of FIG. 1 and the actuating element 11 is returned into its initial position.

FIG. 2 illustrates, in broken lines, the position of the mounting member 3 prior to the movement of the brush component 22 towards its extended position. It may be seen that the actuating element 11 must at least partially be returned towards its initial position before the mounting member 3 is allowed to assume the position illustrated in broken lines in FIG. 2.

As already mentioned previously, the mounting member 4 has two faces 28 and 29 which enclose an angle with one another. Preferably, such angle corresponds to the angle of pivoting of the mounting members 3 and 4 between their positions illustrated in FIGS. 1 and 2 in full lines. The faces 28 and 29 of the mounting member 4 are seen through the display window 30 of the housing component 32, that is, that one of the faces 28 and 29 which is indicative of the position assumed by the brush component 22 is in registry with the display window 20. Each of the faces 28 and 29 may be provided with a distinct marking distinguishing the same from the other face, such as a symbol, a color or the like, so that the momentarily assumed position of the brush component 22 can be easily ascertained by visually observing which one of the distinctively marked faces 28 and 29 appears in the window 30.

It will be understood that each of the elements described above, or two or more together, may also find a useful application in other types of constructions differing from the types described above.

While the invention has been illustrated and described as embodied in an attachment for use with a vacuum cleaner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A suction attachment for vacuum cleaners, comprising a housing having a portion juxtaposable with a surface to be vacuum cleaned, an interior which opens onto such portion, and an exhaust port communicating with said interior and connectable to a vacuum cleaner; a cleaning element accommodated in said interior of said housing and having a support and a cleaning member mounted on said support; means for mounting said cleaning element on said housing for displacement relative thereto between a retracted position in which said cleaning member is received in said interior, and an extended position in which said cleaning member extends to the exterior of said housing and beyond the latter into direct contact with the surface to be cleaned and including at least two mounting members mounted on said support for pivoting relative to said support about respective pivot axes; operating means, including a single operator engaged actuating element, for alternately displacing said cleaning member from said retracted into said extended position and from said extended into said retracted position thereof and means for simultaneously pivoting said mounting members about said respective pivot axes, including means for angularly displacing one of said mounting members about the respective pivot axis thereof, and at least one connecting member connecting said mounting members to each other to thereby angularly displace the other mounting member in synchronism with the angular displacement of said one mounting member.

2. An attachment as defined in claim 1, wherein said housing is elongated and has longitudinally spaced ends; wherein said pivot axes of said mounting members are respectively situated between the middle and the ends of said housing; and wherein said connecting member extends longitudinally of said housing.

3. An attachment as defined in claim 2, wherein said mounting members have transversely spaced end portions; wherein said connecting portions are arranged at one of said end portions of each of said mounting members; wherein each of said mounting members has an additional connecting portion at the other end portion thereof; and further comprising an additional connecting member articulated to said additional connecting portions of said mounting members and extending parallel to said one connecting member.

4. An attachment as defined in claim 2, wherein said housing has a central portion intermediate said spaced ends; and wherein said exhaust port is provided at said central portion.

5. An attachment as defined in claim 1, wherein said cleaning member of said cleaning element includes a plurality of bristles.

6. An attachment as defined in claim 1, wherein at least an of said mounting members has a support portion engaging said single operating means and connecting portion for connecting with said means for simultaneously pivoting said mounting means.

7. An attachment as defined in claim 6, wherein said angularly displacing means includes an actuating element mounted on said housing for displacement relative thereto in a path between a first and a second position and having a contact portion accessible from the exterior of said housing component, and means for biasing said actuating element toward said first position thereof; and wherein said one mounting member has at least one actuating portion which is spaced from the respective pivot axis of said one mounting member and extends into said path of displacement of said acutating element to be displaced by the latter during the displacement of the same toward said second position thereof and thereby angularly displace said one mounting member toward a position corresponding to said extended position of said cleaning element.

8. An attachment as defined in claim 7, wherein said actuating element has an inclined surface contacting said actuating portion during the displacement of said actuating element between said first and second positions and displacement of said cleaning member between said retracted and extended positions.

9. An attachment as defined in claim 7; wherein said single operated means has at least one slanted surface in engagement with said support portion of said other mounting member; and wherein said mounting and connecting members are so situated with respect to said other element in said extended position of said cleaning component that said support portion of said other mounting member arrests said other mounting member on said slanted surface against angular displacement toward said retracted position of said cleaning element.

10. An attachment as defined in claim 7, and further comprising means for arresting said cleaning elements in said extended position thereof; and wherein said actuating element further includes means for releasing said cleaning element for displacement toward said retracted position thereof, including a flexible element a releasing portion of said one mounting member spaced from the respective pivot axis of the latter and extending into the path of displacement of said flexible element when said cleaning element is in said extended position thereof.

11. An attachment as defined in claim 10, wherein said releasing portion has a side surface which engages and flexes said flexible element during the displacement of said cleaning element toward said extended position thereof.

12. An attachment as defined in claim 10, wherein said actuating and releasing portions of said one mounting member are disposed about the respective axis of the latter at an angle of substantially 90°.

13. An attachment as defined in claim 10, wherein said releasing portion of said one mounting member has an end face formed with a depression adapted to receive an end portion of said flexible element.

14. A suction attachment for vacuum cleaners, comprising a housing having a portion juxtaposable with a surface to be cleaned, an interior which opens onto such portion, and an exhaust port communicating with said interior and connectable to a vacuum cleaner; a cleaning element accommodated in said interior of said housing and displaceable from a retracted position in which said cleaning element is received in said interior into an extended position in which said cleaning element extends beyond said housing into direct contact with the surface to be cleaned, and indicating means in said housing for indicating the position of said cleaning element, said means having at least one mounting member pivotably mounted on said cleaning element for pivoting about a pivot axis in response to the displacement of said cleaning element, said mounting member having two faces which enclose with one another an angle substantially corresponding to the range of angular displacement of said mounting member about the pivot axis thereof, and each of said faces being provided with an indication corresponding to different positions of said cleaning element, said housing having a display window in registry with the respective face of said mounting member in each of said positions of said cleaning element, so that a user can immediately determine through said display window the present position of said cleaning element.

15. An attachment as defined in claim 14, wherein each of said faces has an appearance distinct from that of the other face.

16. A suction attachment for vacuum cleaners, comprising a housing having a portion juxtaposable with a surface to be vacuum cleaned, an interior which opens onto such portion, and an exhaust port communicating with said interior and connectable to a vacuum cleaner, a cleaning member accommodated in said interior of said housing and displaceable from a retracted position in which said cleaning member is received in said interior into an extended position in which said cleaning member extends beyond said housing into direct contact with the surface to be cleaned, operating means including a single operating element for alternately displacing said cleaning member from said extended into said retracted position thereof, and a mounting member mounted on said cleaning element operatively engageable with said operating means, said operating means having a first actuating element causing when engaged with said mounting member the extension displacement of the cleaning element, a second actuating element causing when engaged with said mounting member the retraction displacement of the cleaning element, said second actuating element being flexible so as to yield in response to engagement of said actuating elements with said mounting member during the extension displacement of the cleaning member and thereby to avoid actuation of the retraction displacement.

17. An attachment as defined in claim 1; further comprising indicating means in said housing for indicating the position of said cleaning element, including two faces on said other mounting member which enclose with one another an angle related in a predetermined ratio to the range of angular displacement of said other mounting member about the respective pivot axis thereof in response to the displacement of said cleaning element between said position, each of said faces being provided with an indication corresponding to different positions of said cleaning element.

18. An attachment as defined in claim 17, wherein said indicating means further include a display window in registry with the respective face of said mounting member in each of said positions of said cleaning element, so that a user can immediately determine through said display window the present position of said cleaning element.

* * * * *